US006869043B1

(12) United States Patent
Carlyle et al.

(10) Patent No.: US 6,869,043 B1
(45) Date of Patent: Mar. 22, 2005

(54) DEPLOYABLE FLARE WITH SIMPLIFIED DESIGN

(75) Inventors: John Daryl Carlyle, Santa Barbara, CA (US); William Hall, Santa Barbara, CA (US); Hartley Hughes King, Santa Barbara, CA (US); Thomas Louis Menna, Santa Barbara, CA (US); Lawrence Steven Romero, Santa Ynez, CA (US)

(73) Assignee: AT&T Corp., New York, NY (US)

( * ) Notice: Subject to any disclaimer, the term of this patent is extended or adjusted under 35 U.S.C. 154(b) by 5 days.

(21) Appl. No.: 10/396,220

(22) Filed: Mar. 24, 2003

(51) Int. Cl.[7] ..... F42B 10/00

(52) U.S. Cl. ..... 244/3.28; 244/3.23; 244/3.1; 102/339; 102/340; 102/400; 102/520

(58) Field of Search ..... 102/400, 339–340, 102/384, 377, 520; 244/160, 3.1, 3.23, 3.25–3.29; 135/22

(56) References Cited

U.S. PATENT DOCUMENTS

| | | | | | |
|---|---|---|---|---|---|
| 609,003 | A | * | 8/1898 | Borelli | 244/3.27 |
| 724,326 | A | * | 3/1903 | Pepperling | 102/400 |
| 1,218,832 | A | * | 3/1917 | Bondurant | 102/400 |
| 1,318,858 | A | * | 10/1919 | Frick | 102/400 |
| 3,016,910 | A | * | 1/1962 | Rosenkaimer | 135/22 |
| 3,695,556 | A | * | 10/1972 | Gauzza et al. | 244/3.29 |
| 3,952,662 | A | * | 4/1976 | Greenlees | 102/400 |
| 4,295,290 | A | * | 10/1981 | Boswell | |
| 4,546,940 | A | | 10/1985 | Andersson et al. | |
| 4,896,845 | A | * | 1/1990 | Peretti et al. | 244/3.1 |
| H905 | H | * | 4/1991 | Rottenberg | 244/3.28 |
| 5,020,436 | A | * | 6/1991 | Coburn | 102/377 |
| 5,452,864 | A | * | 9/1995 | Alford et al. | 244/3.23 |
| 5,464,172 | A | | 11/1995 | Jensen et al. | |
| 6,053,188 | A | * | 4/2000 | Walker | |
| 6,234,082 | B1 | * | 5/2001 | Cros et al. | 102/520 |
| 6,240,849 | B1 | * | 6/2001 | Holler | 102/439 |
| 6,336,609 | B1 | * | 1/2002 | Johnsson | 244/3.29 |
| 6,352,218 | B1 | * | 3/2002 | Holmqvist et al. | 244/3.29 |
| 6,454,205 | B2 | * | 9/2002 | Niemeyer et al. | 244/3.26 |
| 6,502,786 | B2 | * | 1/2003 | Rupert et al. | 244/3.27 |
| 6,520,193 | B2 | * | 2/2003 | You | |

* cited by examiner

*Primary Examiner*—Michael J. Carone
*Assistant Examiner*—L. Semunegus
(74) *Attorney, Agent, or Firm*—Ronald D. Slusky

(57) ABSTRACT

The center of pressure of a projectile is caused to move upon the occurrence of an event that changes the static margin, such as the jettisoning of a body previously attached to the projectile, as noted above. In particular embodiments, this is achieved by a flare disposed toward the rear of the projectile. The flare has petals that deploy from a first, stowed position to a second, deployed position upon the occurrence of the event. In the stowed position, the petals are aligned with the air stream, in order to minimize drag. In the deployed position, the petals project into the air stream in such a way as to move the lift center rearward. A slide ring within the flare has sufficient inertia that it shifts aft in response to an acceleration that occurs when the attached body and the projectile are separated from one another. The slide ring is linked to the petals in such a way that the petals are deployed by the displacement of the slide ring. Detents lock the slide ring in its displaced position.

16 Claims, 7 Drawing Sheets

DEPLOYABLE FLARE WITH SIMPLIFIED DESIGN

BACKGROUND OF THE INVENTION

The present invention relates to the stabilization of projectiles in flight.

The invention more particularly relates to the aerodynamic stabilization of projectiles of a type that, during flight, are designed to jettison either a forward or an aft body that was connected to the projectile when it was initially launched, as from a gun or a missile. Those skilled in the art are well aware of the context or contexts in which such a mode of operation occurs.

Aerodynamic stabilization of a projectile in flight, i.e., preventing it from tumbling, is achieved by making the center of the lifting forces, also referred to as the center of pressure, lie behind the center of mass. The distance between these centers and divided by the total projectile length is called the static margin. Even if the projectile is stable when launched, its static margin may sufficiently change after the body that was attached to it is jettisoned that the static margin is no longer sufficient to ensure stable flight.

Reference is made to the co-pending and commonly-assigned United States patent application of Hartley H. King, Thomas Louis Menna and Lawrence S. Romero, Ser. No. 10/396,222, filed of even date herewith entitled, "Aerodynamic Stabilization of a Projectile," and hereby incorporated herein by reference. In accordance with the invention set forth in that patent application, the lift force center, or center of pressure, of a projectile is caused to move upon the occurrence of an event that changes the static margin, such as the jettisoning of a body previously attached to the projectile. This is illustratively achieved by a Rare disposed toward the rear of the projectile. The flare has elements that deploy from a first, stowed position to a second, deployed position upon the occurrence of the jettisoning, or separation, event. In the stowed position, the deployable elements are aligned with the air stream, in order to minimize drag. In the deployed position, the deployable elements project into the air stream in such a way as to move the lift center rearward. Deployment of the deployable elements is illustratively achieved by taking advantage of an abrupt change in velocity (i.e., an acceleration or deceleration) that occurs when the attached body and the projectile are separated from one another by, for example, the setting off of a propellant charge that drives them apart while in flight. An inertial component of the flare, illustratively a slide ring, is arranged to shift position relative to the rest of the flare in response to the abrupt velocity change and is connected to the deployable elements in such a way, and has sufficient inertia, as to move the deployable elements to their deployed positions upon separation. A detent mechanism is provided to lock the deployable elements in place once they have been moved to their deployed position. This is illustratively achieved by locking the aforementioned inertial component in its displaced position. The projectile launch acceleration may be on the order of four times as large as the separation acceleration. In order to prevent the aforementioned inertial component from prematurely deploying the deployable elements during the launch acceleration of the projectile, the flare illustratively includes a plurality of slide supports, supported by a retaining element, thereby keeping the shifting element and the deployable elements in their original positions. The retaining element also engages with the deployable elements to preclude any fluttering in flight that might occur while they are in their stowed position. The retaining element detaches from the rest of the flare at the separation event, thereby allowing the deployable elements to deploy under the influence of the inertial component.

A particular embodiment of the flare referred to herein as "the first embodiment"—is the subject of the co-pending and commonly-assigned United States patent application of Hartley Hughes King, Thomas Louis Menna and Lawrence Steven Romero, Ser. No. 10/396,221, filed of even date herewith entitled, "Deployable Flare for Aerodynamically Stabilizing a Projectile" and hereby incorporated herein by reference.

SUMMARY OF THE INVENTION

The present invention is directed to a further embodiment of the flare that has fewer parts and is more inexpensively manufactured than the first embodiment.

In accordance with a feature of the invention, the detent function is provided by a plurality of fingers, or detents, attached to the inertial component and each extending into a respective recess within a support ring at the front end of the flare. By the time the inertial component has reached its limit of rearward travel, the detents have been completely pulled from recesses and are formed in such a way that they spring to the side at that time so as to be adjacent to a solid face of the support ring rather than facing the opening of, and being aligned with, their respective recesses. The detents are thus prevented from re-entering support ring. Thus once the inertial component has been moved to its displaced position, the detents lock the inertial component in place and prevent it from returning to its original position, thereby maintaining the deployable elements in their outwardly swung position.

In accordance with another feature of the invention, the slide supports, like the detents, are attached to the inertial component. By contrast, the slide supports in the first embodiment are simply wedged in place. The potential disadvantage of the wedged-in-place approach is that the slide supports may fly into other parts of the flare and interfere with its operation or they might interfere with the continuing flight of the projectile or the aft body. Advantageously the slide supports of the present invention remain affixed within the flare after the separation event, precluding any of that from happening. In the present disclosed embodiment, the slide support and detent are parts of an integral slide support/detent component that is threaded through the inertial element with the detent portion extending in the direction of the support ring and the slide support portion extending in the direction of the retaining element. This design advantageously lowers the part count for the flare and helps keep its manufacturing costs low.

In accordance with another feature of the invention, the retaining element is a single part having arms to engage the deployable elements when the flare is in its undeployed configuration, and the retaining element is attached to the aft body. When the aft body is jettisoned, the retaining element is pulled away from the deployable elements, allowing them to open responsive to the movement of the inertial element. By contrast, the retaining element in the first embodiment comprises a ring made up of individual wedge-shaped elements of relatively intricate design that are wedged between the aft body and the projectile and that fall away when the aft body and projectile separate. Here, again, there is the potential for such free-flying parts to interfere with the operation of the flare or with the continuing flight of the projectile or the aft body. The fact that the retaining element of the present embodiment remains connected to the aft body precludes any of that from happening. Moreover, the fact that the retaining element it is a single part of simple design, rather than an assemblage of individual elements of relatively intricate design, again reduces the part count of the flare and contributes to a lower cost of manufacture.

Various hinge pins in the first embodiment are held in place by having a threaded portion that threads into one or the other of the flare's components. The present embodiment, by contrast, uses simple non-threaded pins that are inserted through apertures in the deployable elements and held in place by flaring their ends after insertion. This approach makes assembly of the present embodiment quicker and less labor-intensive.

In addition, the first embodiment has six deployable elements whereas we have discovered that the desired functionality of the flare can be achieved with no more than four deployable elements, again lowering the part count and manufacturing costs.

DETAILED DESCRIPTION OF AN ILLUSTRATIVE EMBODIMENT

Figure 1:
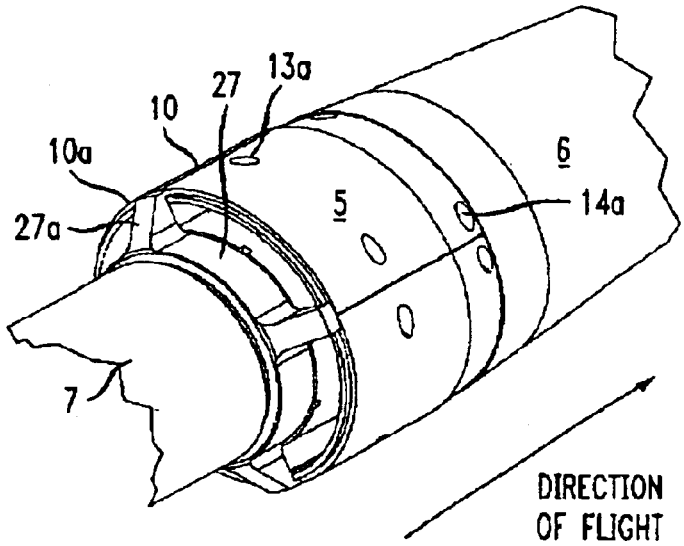
FIG. 1 shows a deployable flare embodying the principles of the invention attached to a portion of the projectile whose flight the flare is intended to stabilize.

FIG. 1 shows a flare 5 embodying the principles of the present invention attached to a projectile 6 whose intended direction of flight is as shown. An aft body 7 extends through the center of flare 5 and is attached to the internal body of projectile 6.

Figure 2:
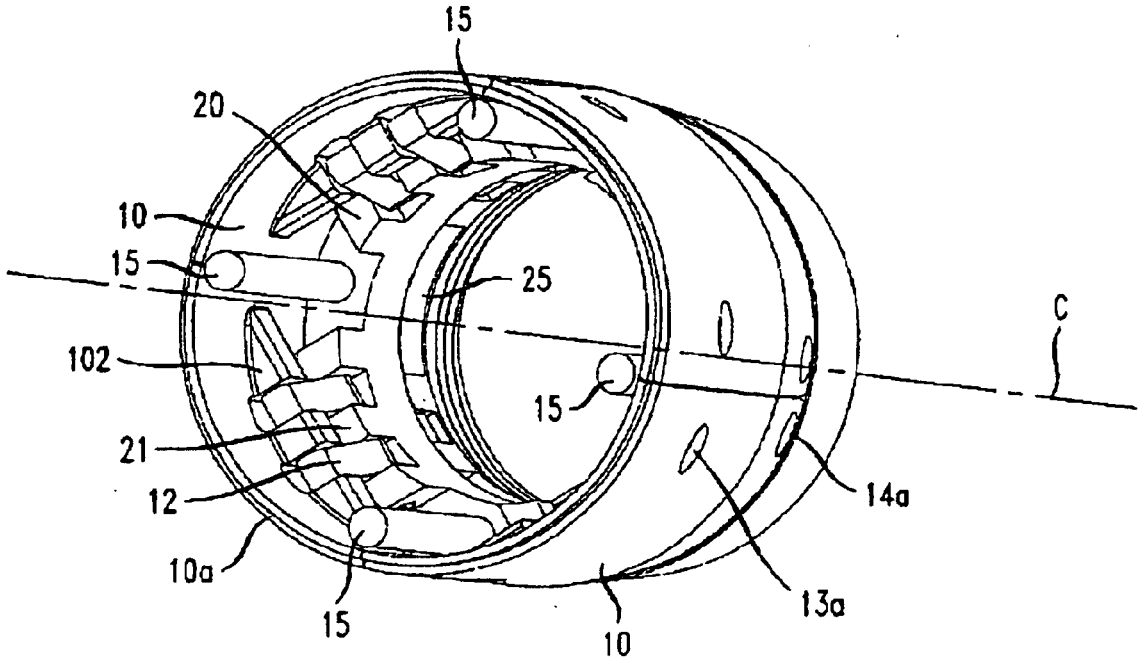
FIG. 2 shows the deployable flare in a stowed configuration.
Figure 3:
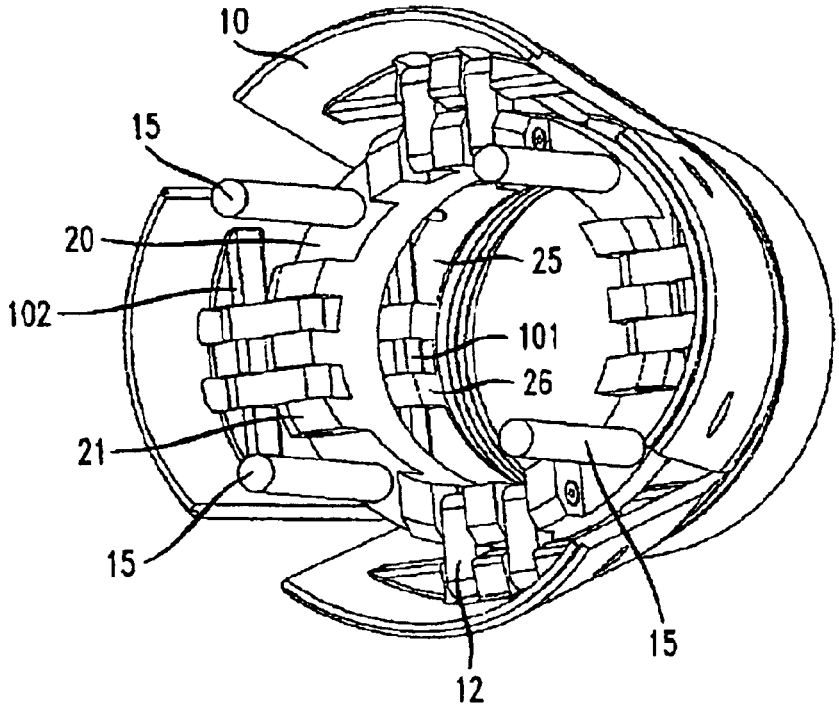
FIG. 3 shows the deployable flare in a deployed configuration.
Figure 4:
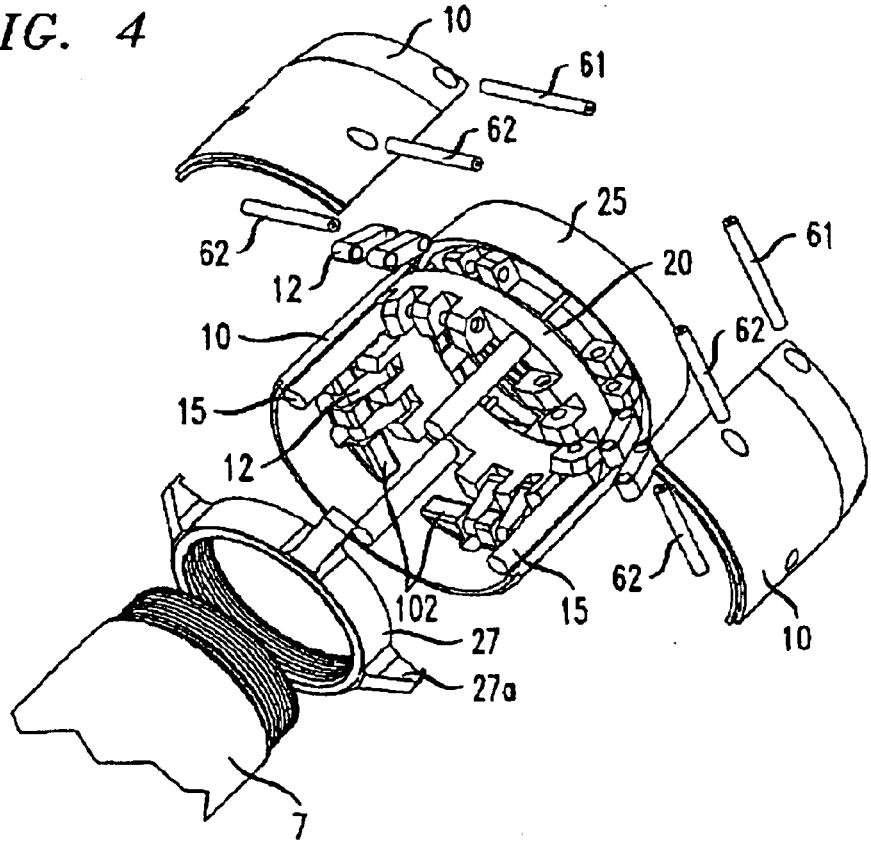
FIG. 4 is an exploded view of the flare.

The construction of flare 5 can be seen in FIGS. 2 through 4. The flare includes a threaded support ring 25 that threads onto projectile 6, with an aft portion of projectile 6 (not shown) extending through the center of the flare. Attached to support ring 25 are four petals 10 arrayed in a first position around central axis C of the flare. Petals 10 are each in the form of a cylindrical segment whose side edges meet to form a cylinder whose central axis is coincident with said axis of the flare.

Figure 5:
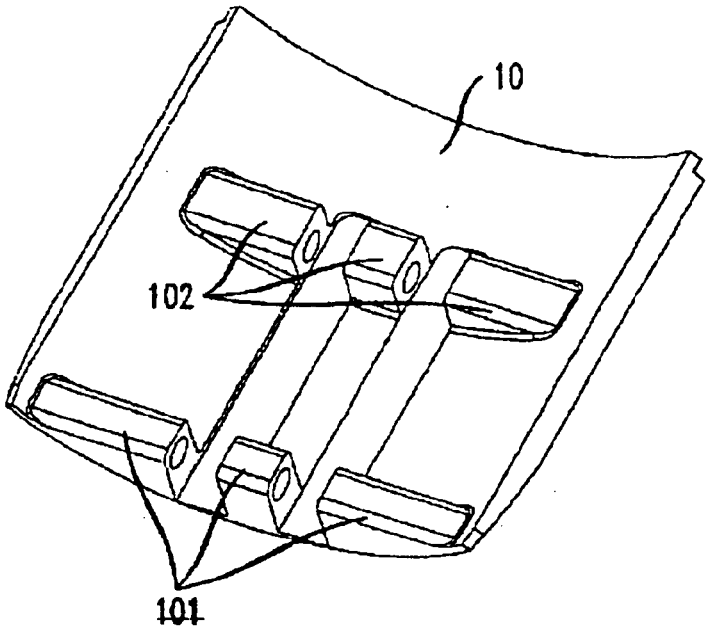
FIG. 5 shows the interior surface of one of the petals of the flare.
Figure 6:
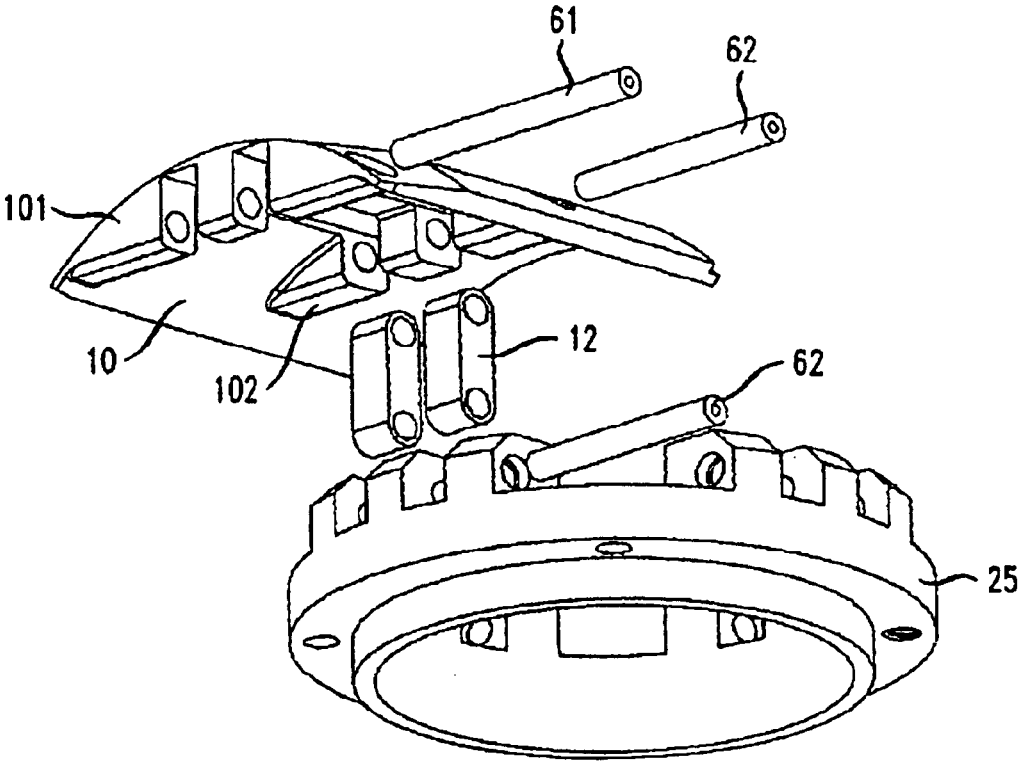
FIG. 6 shows how the petals are linked to the flare's slide ring.
Figure 11:
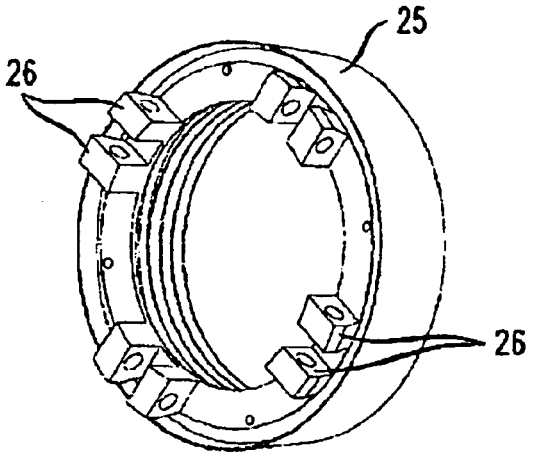
FIG. 11 shows the flare's support ring.
Figure 12:
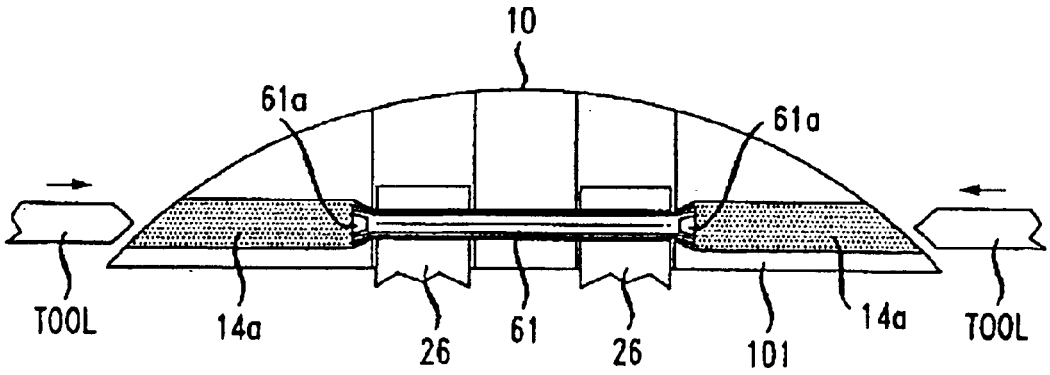
FIG. 12 is a cross-sectional view of one of the petals showing a detail of one of its hinge pins.

A detailed view of one of the petals 10 is shown in FIG. 5. A hinge element 101 is disposed on the inside surface of petal 10 near its forward edge. The hinge element 101 of each petal mates with a corresponding hinge element 26 attached to support ring 25, as can be seen in FIG. 11. As can be seen in FIG. 6, hinge elements 101 on slide ring 20 and 26 on support ring 25 are held together by a pin 61 inserted through one of the openings 14*a* (FIG. 1) and fitted below the petal's external surface. Pin 61 is essentially cylindrical over its entire length when inserted through one of the openings 14*a*. As shown in FIG. 12, pin 61 is held in place by flaring its ends after the pin has been been installed. This is achieved by inserting a pointed tool into a notch 61*a* in each end of pin 61 and applying sufficient force from both sides simultaneously to flare the pin ends as shown. The gap between the flared end and the petal's external surface is filled with a high temperature epoxy to keep the petal surface aerodynamically smooth. This hinging arrangement enables the aft edges 10*a* of petals 10 to swing outwardly from said axis of the flare, thereby moving from a stowed, undeployed, or closed position, as shown in FIGS. 1 and 2, to a deployed, or open position, as shown in FIG. 3.

A petal retaining ring 27 threaded onto aft body 7 has arms 27*a* that grab onto aft ends 10*a* of petals 10. This keeps petals 10 from fluttering during flight, should they have any tendency to do so. When aft body 7 is jettisoned from projectile 6, petal retaining ring 27 is pulled away from petals 10, allowing them to be moved to the open position.

Flare 5 further includes an inertial component in the form of slide ring 20 centered on axis C. Disposed on slide ring 20 are hinge elements 21. Links 12 interconnect hinge elements 21 with corresponding ones of hinge elements 102 disposed on the interior surface of petals 10. The links are held in place by pins 62 extending through both hinge elements 21 and 102 inserted via apertures 13*a*. Each pin 62 is inserted and flared in the same manner as the pins 61, as described above. Slide ring 20 along with the linkages just described thus form part of an actuating mechanism for the petals in that rearward motion of slide ring 20 parallel to axis C from its original position (as seen in FIG. 2) to a displaced position (as seen in FIG. 3) swings petals 10 from their closed to their open positions. Once in its open position, the flare adds a significant among of drag to the flying projectile. In applications in which the remainder of the projectile's flight is expected to be quite short, this additional drag is not of concern. For applications that require lower drag for longer flights, the petal design can be modified as needed.

Figure 7A:
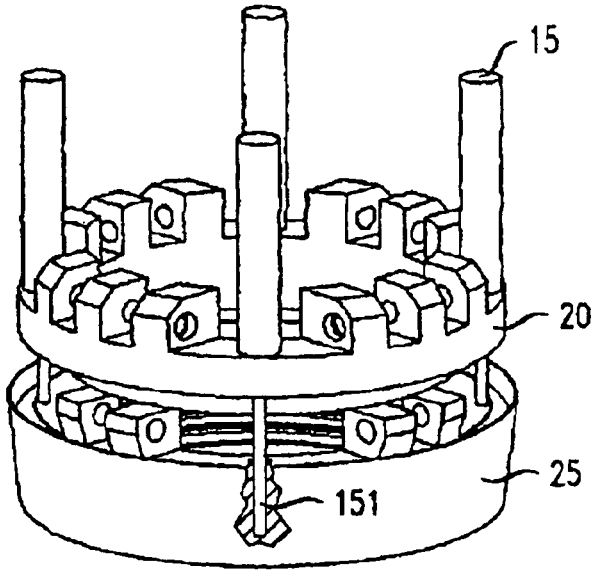
FIGS. 7*a* and 7*b* show the support ring and the flare's slide ring (inertial component) in the latter's original and displaced positions.
Figure 7B:
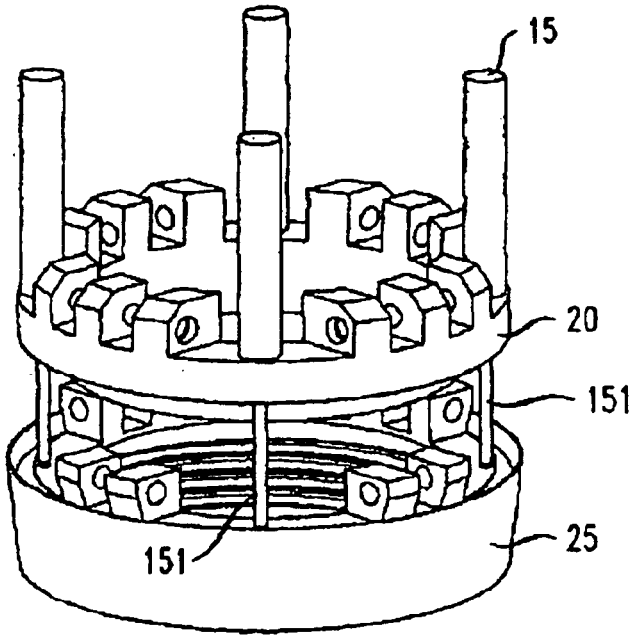
Figure 8:
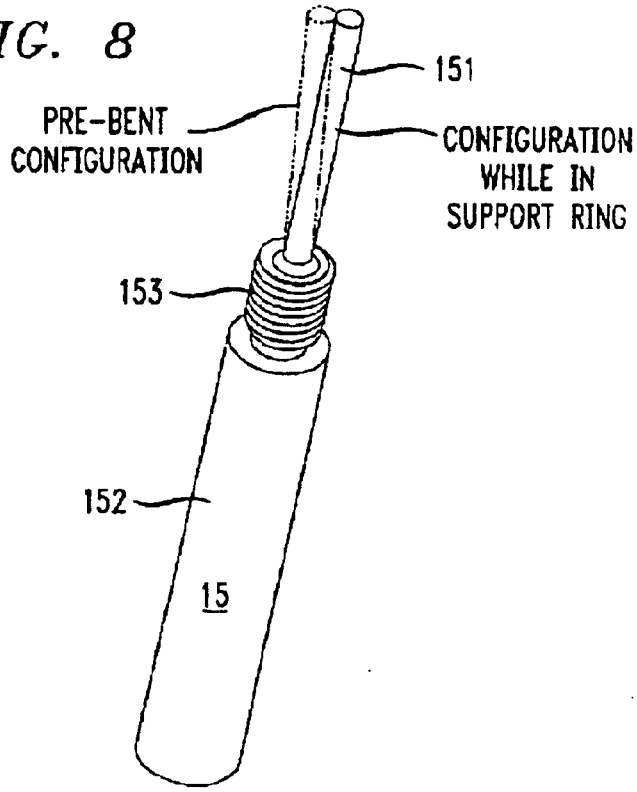
FIG. 8 shows one of the flare's detent/slide supports.

FIGS. 7*a* and 7*b* show that extending through slide ring 20 are four detent/slide supports 15 having an integral detent. As shown in FIG. 8, each detent/slide support 15 comprises a detent 151, a slide support 152 and a threaded portion 153, the latter being threaded into a respective hole in slide ring 20. In alternative embodiments, the detents and slide supports could be completely separate elements independently affixed to slide ring 20.

Figure 9:
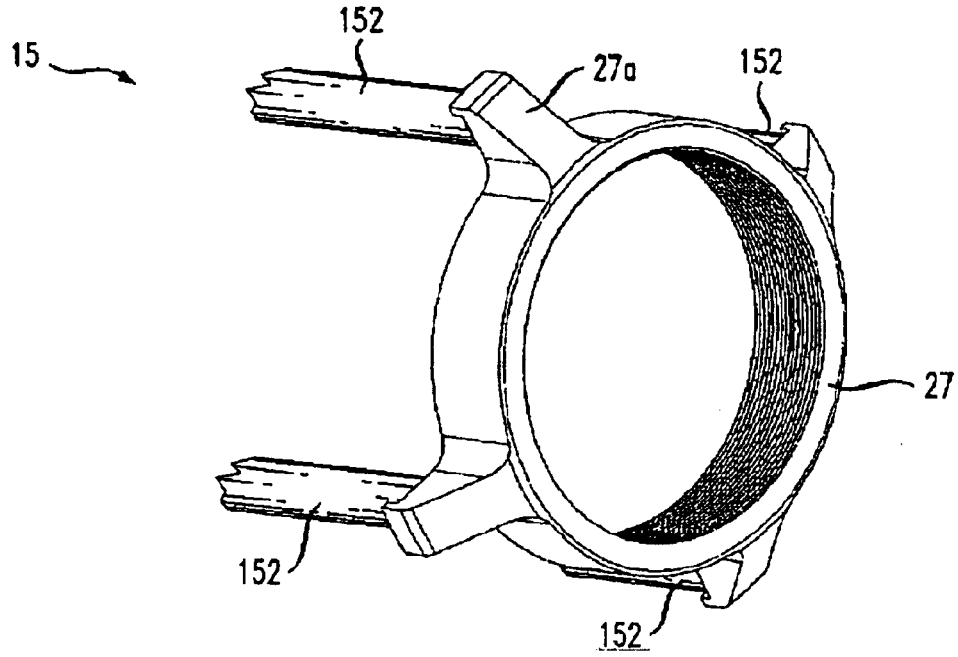
FIG. 9 shows a petal retaining ring that forms a part of the flare.

When the flare is in its closed position, slide supports 152 rest on petal retaining ring 27, as shown in FIG. 9, so that petal retaining ring 27 serves as a base for the slide supports to react the structural load placed on the slide ring when the projectile is initially launched. As also shown in FIG. 7*a*, each one of detents 151 extends into a respective recess 24 of support ring 25 when the flare is in its closed position. This recess is concentric with the slide support axis.

By the time slide ring 20 has reached the limit of rearward travel—which is imposed by the slide ring's connection to petals 10 via links 12—detents 151 have been completely pulled from recesses 24. Prior to being inserted in recesses 24, detents 151 had a bend of about 4 degrees off the detent/slide support axis, as shown in FIG. 8. (The amount of bend is exaggerated in the FIG. for clarity.) Detents 151 were thereupon entered into their respective recesses 24 by being pulled into a straightened configuration. Detents 151 have enough resiliency, however, that upon being pulled from recesses 24, they tend to spring to the side to resume a bent configuration that places them adjacent to the solid face 29 of support ring 25 rather than facing the opening of, and being aligned with, their respective recesses. Detents 151 are thus prevented from re-entering support ring 25. Thus once slide ring 20 has been moved to its displaced position, detents 151 lock it in place and prevent it from returning to its original position, thereby maintaining petals 10 in their outwardly swung position.

In operation, the entire assembly comprising projectile 6, flare 5, aft body 7 are initially launched as a unit. The static margin of that overall assembly is sufficient to ensure stable flight of the overall assembly.

During flight, however, a chemical or mechanical instrumentality (not shown) internal to projectile 6 pushes against an element that ultimately connects to aft body 7 and causes aft body 7 to be jettisoned. Such arrangements, and the purposes to which they can be put are known to those skilled in the art and need not be described herein. Suffice it to say that the separation event causes projectile 6 to be accelerated in the direction of flight.

The static margin of projectile 6 after detached from aft body 7 would be insufficient to ensure that projectile 6 will fly stably for the duration of its flight. However, once in its open position, flare 5 causes the center of pressure of projectile 6 to more rearward to thus increase the static margin and ensure stability for the remainder of the flight of projectile 6.

More particularly, the jettisoning of aft body 7 pulls petal retaining ring 27 away from petals 10 and removes support from slide supports 152 so that the petals are no longer inhibited from opening. The configuration of the flare is such that all of the petals deploy simultaneously and symmetrically. The petals therefore disturb the air stream in a way that will not cause a disturbance of the projectile flight path.

The magnitude of the acceleration of projectile 6 and the mass of slide ring 20 are such that the latter's inertia gives rise to its rearward motion relative to support ring 25. (From the pure physics standpoint, one in a stationary reference frame might observe that it is not that slide ring 20 is moving rearward but that support ring 25 is accelerating forward but, of course, the effect is the same.) As noted earlier, detents 151 lock slide ring 20 in its displaced location, thereby locking petals 10 into the open position.

Figure 10:
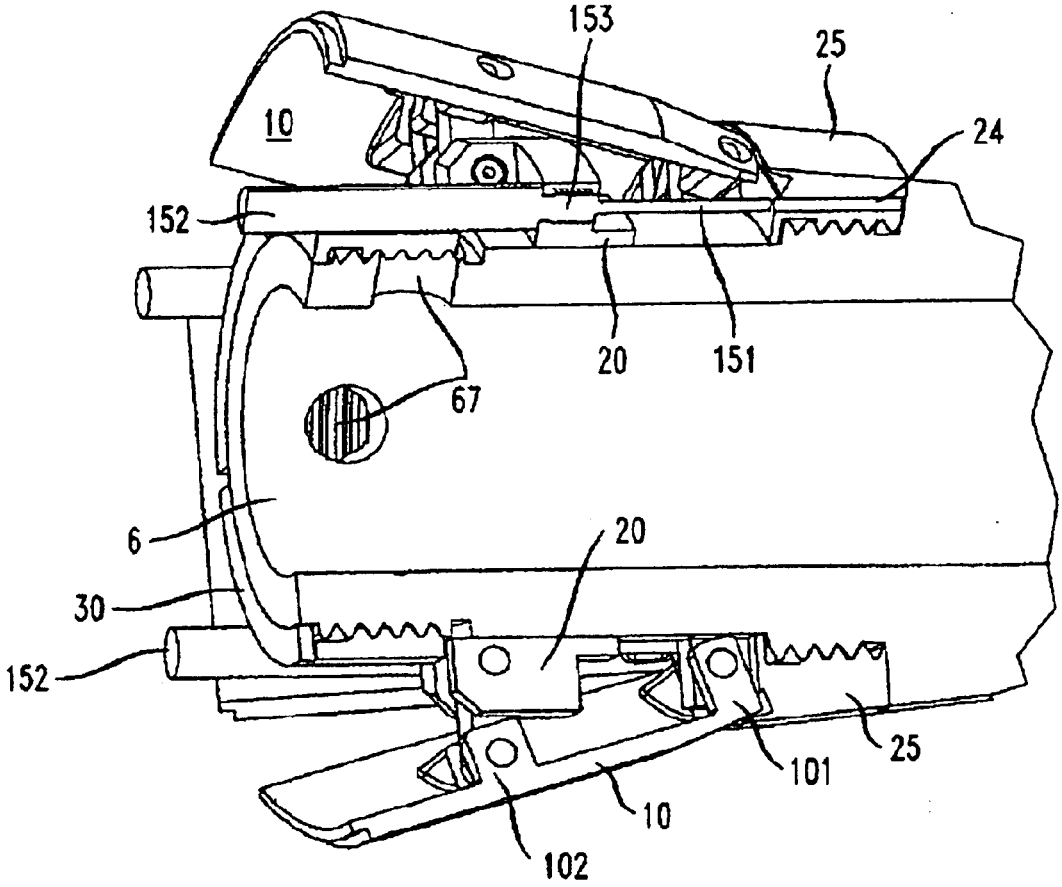
FIG. 10 is a cross-section of the flare in its open position shown attached to the aft end of the projectile.

The configuration of the flare in its open position can be clearly seen in the cross-sectional view of FIG. 10, which provides a particularly good view of one of recesses 24 and of the corresponding detent 151, which has been pulled from the recess. Although not readily apparent in FIG. 10, detent 151 is in its bent position at this time, precluding it from re-entering recess 24. Also seen in FIG. 10 are shear pin holes 67 extending through the body of projectile 6. Shear pins (not shown) had extended through these holes and into the aforementioned element (not shown) connected to aft body 7, thereby connecting aft body 7 to projectile 6. The shear pins had been sheared in two by the separation force, allowing the projectile and aft body to separate.

Also seen in FIG. 10 is a component not mentioned above or shown in any other FIG., namely slide ring stop 30. This part is threaded onto the aft of projectile 6 and provides a stop for slide ring 20, thereby keeping the slide ring from continuing to move off the end of projectile 6 when the flare is opening or thereafter. Slide ring stop 30 also provides confinement for the aforementioned shear pins so that they are not pushed out of holes 67 during the separation event and thereby possibly interfere with the operation of the flare.

The mass and design of the slide ring and the other components should be selected and balanced in such a way to adjust the various forces at play. Given an anticipated level of acceleration of the projectile during the separation event, a large enough force must be exerted by slide ring 20 to deploy the petals but its rearward velocity should not be so large that it rebounds so quickly from slide ring stop 30 that the detents do not have time to return to a bent state and lock the slide ring in place or that the stopping forces are large enough to buckle the detents. This design balance should also include consideration of the forces exerted on the petals, for example, by the air stream at the flight velocity.

The components of the flare can be made out of any desired materials which can withstand the zero heat transfer recovery temperature of the air stream and initial launch acceleration loads. In one embodiment that was built, all components were made of metal; the petals were of titanium and the other components were of steel. However, it is expected that an all-steel construction would be more economical to manufacture but would perform just as well.

Although in the illustrative embodiment aft body 7 is directly connected to projectile 6, a separate coupling element could be use to connect them. That coupling element would form a part of the aft body in the sense that it would remained connected to the aft body at the separation event.

The foregoing merely illustrates the principles of the invention. For example, in some applications it might be intended for the aft body to continue to fly, but its static margin might be insufficient after the separation event, in which case it might be desired for the aft body to include a flare such as that that disclosed herein. However, if the aft body experiences a deceleration during the separation event, the slide ring will not move aft; to the contrary it will be urged forward. Thus any such flare would have to be configured in such a way that the slide ring is allowed to slide forward upon separation and it would have to be linked to the petals in such a way that they open in response to such forward movement of the slide ring.

It will thus be appreciated that those skilled in the art will be able to devise numerous arrangements which, although not shown or described herein, embodying the principles of the invention and thus are within its spirit and scope.

What is claimed is:

1. Apparatus comprising a support member, a projectile to which the support member is attached, an aft body attached to the rear of the projectile and adapted to be jettisoned from the projectile during flight, a plurality of petals each hinged at an end thereof to the support member, the petals being arrayed in a first position around a central axis of the apparatus in a first, undeployed configuration of the apparatus, actuating means operable to swing each of the petals around its hinged end to a second position in a second, deployed configuration of the apparatus, and locking means attached to the actuating means for locking the petals in said second position, wherein the locking means includes at least a first detent finger that is initially positioned in the support member and is pulled out of the support member by the operation of the actuating means, wherein the actuating means includes a slide member that is displaced from an original position to a displaced position responsive to the operation of the actuating means and wherein the detent finger is pulled out of the support member by the displacement of the slide member to the displaced position, and wherein the detent finger is adapted to assume a configuration upon being pulled out of the support member that prevents the detent finger from re-entering the support member and thereby prevents the slide member from returning to its original position.

2. Apparatus comprising a support member, a plurality of petals each hinged at an end thereof to the support member, the petals being arrayed in a first position around a central axis of the apparatus in a first, undeployed configuration of the apparatus, actuating means operable to swing each of the petals around its hinged end to a second position in a second, deployed configuration of the apparatus, means attached to the actuating means for locking the petals in said second position, wherein the actuating means includes a slide member that is displaced from an original position to a displaced position responsive to the operation of the actuating means, retaining means, at least one slide support attached to the slide member, the retaining means providing a base for the slide support and thereby initially preventing movement of the slide member, a projectile to which the support member is attached, and an aft body attached to the rear of the projectile and adapted to be jettisoned from the projectile during flight.

3. The apparatus of claim 2 wherein the retaining means is connected to the aft body, whereby the retaining means is pulled away from the projectile when the aft body is jettisoned, thereby allowing movement of the slide member.

4. The apparatus of claim 3 wherein the retaining means is a unitary element having arms each of which engages with a respective one of the petals.

5. Apparatus comprising a support member, a plurality of petals each hinged at an end thereof to the support member, the petals being arrayed in a first position around a central axis of the apparatus in a first, undeployed configuration of the apparatus, and a slide member operable to move from an original position to a displaced position and to thereby swing each of the petals around its hinged end to a second position in a second, deployed configuration of the apparatus, retaining means, at least one slide support attached to the slide member, the retaining means providing a base for the slide support and thereby initially preventing movement of the slide support, a projectile to which the support member is attached, and an aft body attached to the rear of the projectile and adapted to be jettisoned from the projectile during flight.

6. The apparatus of claim 5 wherein the retaining means is connected to the aft body, whereby the retaining means is pulled away from the petals when the aft body is jettisoned from the projectile.

7. The apparatus of claim 6 wherein the retaining means is a unitary element having arms each of which engages with a respective one of the petals.

8. Apparatus including a flare, the flare comprising a support ring having a plurality of hinge points disposed on one side of the ring, a plurality of petals each in the form of a cylindrical segment having forward and aft edges and a pair of opposing side edges, each petal having at least one hinge point disposed toward one its forward edge and connected to a respective hinge point of the ring in such a way that the side edges of the petals meet to form a cylinder whose axis passes through the center of the support ring, a slide ring centered on said axis and disposed within the cylinder, the slide ring having an original position adjacent to the support ring, the slide ring having a plurality of hinge points, there being at least one of those hinge points associated with each of the petals, each of the petals having at least one hinge point disposed on the interior side of the petal and associated with a respective hinge point on the support ring, and a plurality of links each connecting one of the hinge points on the slide ring with the associated petal hinge point in such a way that movement of the slide ring in a direction parallel to said axis and away from the support ring to a displaced position causes the aft edge of each the petals to swing outwardly away from said axis, and means connected to the slide ring for locking the slide ring in the displaced position once it has moved there, thereby maintaining the petals in an outwardly swung position.

9. The apparatus of claim 8 wherein means for locking comprises a plurality of pre-bent resilient detents each connected to the slide ring and each straightened to be aligned with and inserted into a respective recess in the support ring when the slide ring is in said original position, each detent being pulled from the respective recess and returning to a pre-bent state upon the movement of the slide ring to said displaced position so as to be no longer aligned with its respective recess and so as to thereby prevent the slide ring from returning to its original position once it is in its displaced position.

10. The apparatus of claim 8 wherein there are four of said petals.

11. The apparatus of claim 8 wherein each of the petals is connected to a hinge point of the support ring using at least one flared-end pin.

12. The apparatus of claim 8 further comprising a retaining means, and plurality of slide supports attached to the slide ring, the retaining means providing a base for the slide supports and thereby preventing movement of the slide ring.

13. The apparatus of claim 12 further wherein the retaining means is adapted to grab the aft edge of each of the petals, the retaining means being able to be pulled away from the petals, thereby allowing subsequent movement of the slide ring and thereby allowing the petals to swing outwardly in response to said movement.

14. The apparatus of claim 13 further comprising a projectile to which the support ring is attached, and an aft body attached to the rear of the projectile and adapted to be jettisoned from the projectile during flight.

15. The apparatus of claim 14 wherein the retaining means is connected to the aft body, whereby the petal retaining means is pulled away from the petals when the aft body is jettisoned from the projectile.

16. The apparatus of claim 14 further comprising means for accelerating the projectile coincident with the jettisoning of the aft body, the magnitude of the acceleration and the mass of the slide ring being such that the inertia of the slide ring gives rise to movement of the slide ring relative to the support ring.

* * * * *